US010873814B2

(12) United States Patent
Vilkamo et al.

(10) Patent No.: US 10,873,814 B2
(45) Date of Patent: Dec. 22, 2020

(54) ANALYSIS OF SPATIAL METADATA FROM MULTI-MICROPHONES HAVING ASYMMETRIC GEOMETRY IN DEVICES

(71) Applicant: Nokia Technologies Oy, Espoo (FI)

(72) Inventors: Juha Vilkamo, Helsinki (FI); Miikka Vilermo, Siuro (FI); Mikko Tammi, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 16/461,606

(22) PCT Filed: Nov. 10, 2017

(86) PCT No.: PCT/FI2017/050778

§ 371 (c)(1),
(2) Date: May 16, 2019

(87) PCT Pub. No.: WO2018/091776

PCT Pub. Date: May 24, 2018

(65) Prior Publication Data

US 2020/0068309 A1 Feb. 27, 2020

(30) Foreign Application Priority Data

Nov. 18, 2016 (GB) ..... 1619573.7

(51) Int. Cl.
*H04R 3/00* (2006.01)
*H04R 5/00* (2006.01)
(Continued)

(52) U.S. Cl.
CPC ..... *H04R 5/04* (2013.01); *H04R 3/005* (2013.01); *H04R 3/04* (2013.01); *H04R 5/027* (2013.01)

(58) Field of Classification Search
CPC . H04R 3/00; H04R 3/005; H04R 3/04; H04R 5/00; H04R 5/02; H04R 5/04;
(Continued)

(56) References Cited

U.S. PATENT DOCUMENTS

2011/0317041 A1 12/2011 Zurek et al. ..... 348/240.99
2012/0051548 A1* 3/2012 Visser ..... G10L 21/0208 381/56

(Continued)

FOREIGN PATENT DOCUMENTS

CN 103190158 A 7/2013
WO WO 2016/096021 A1 6/2016

OTHER PUBLICATIONS

Kowalczyk, K., et al., "Parametric Spatial Sound Processing", © 2015 IEEE, IEEE Signal Processing Magazine, Mar. 2015, 12 pgs.

*Primary Examiner* — Thang V Tran
(74) *Attorney, Agent, or Firm* — Harrington & Smith

(57) ABSTRACT

An apparatus including a predetermined shape, the apparatus including at least three microphones, wherein at least one pair from the at least three microphones comprises including two microphones which are separated by a shorter distance of the predetermined shape than at least one other microphone pair of the predetermined shape; and a processor configured to: receive at least three microphone audio signals from the at least three microphones; analyse at least the microphone audio signals from the two microphones to determine a directional ambiguity decision; and analyse the microphone audio signals from at least one of the other microphone pairs to determine at least one sound characteristic other than the direction ambiguity.

20 Claims, 9 Drawing Sheets

(51) Int. Cl.

| | |
|---|---|
| ***H04R 1/20*** | (2006.01) |
| ***H04R 5/04*** | (2006.01) |
| ***H04R 3/04*** | (2006.01) |
| ***H04R 5/027*** | (2006.01) |

(58) Field of Classification Search
CPC ..... H04R 5/027; H04R 1/08; H04R 1/028; H04R 1/20; H04R 1/32; H04R 1/326; H04R 1/40; H04R 1/406; H04R 2499/11; H04R 2430/21; H04R 2201/40; H04R 2400/15; H04S 3/00; H04S 7/00; H04S 7/303; H04S 7/304; H04S 2420/03; H04S 2400/15
See application file for complete search history.

(56) References Cited

U.S. PATENT DOCUMENTS

| | | | | |
|---|---|---|---|---|
| 2012/0128160 | A1 | 5/2012 | Kim et al. | 381/17 |
| 2012/0224716 | A1* | 9/2012 | Ohtsuka | H04R 5/027 381/92 |
| 2013/0202114 | A1* | 8/2013 | Tammi | H04R 1/406 381/1 |
| 2013/0272538 | A1 | 10/2013 | Kim et al. | 381/92 |
| 2013/0275872 | A1* | 10/2013 | Kim | G01S 5/186 715/716 |
| 2014/0029761 | A1* | 1/2014 | Maenpaa | H04R 3/005 381/92 |
| 2015/0110275 | A1* | 4/2015 | Tammi | H04S 7/301 381/26 |
| 2015/0208156 | A1 | 7/2015 | Virolainen | |
| 2016/0073198 | A1* | 3/2016 | Vilermo | H04R 5/027 381/26 |
| 2017/0289686 | A1* | 10/2017 | Faller | H04R 3/005 |

* cited by examiner

ANALYSIS OF SPATIAL METADATA FROM MULTI-MICROPHONES HAVING ASYMMETRIC GEOMETRY IN DEVICES

CROSS REFERENCE TO RELATED APPLICATION

This patent application is a U.S. National Stage application of International Patent Application Number PCT/FI2017/050778 filed Nov. 10, 2017, which is hereby incorporated by reference in its entirety, and claims priority to GB 1619573.7 filed Nov. 18, 2016.

FIELD

The present application relates to apparatus and methods for generating spatial metadata for audio signals from asymmetric devices and specifically but not exclusively asymmetric arrangements of microphones on user equipment.

BACKGROUND

Adaptive spatial audio capture (SPAC) methods which employ dynamic analysis of perceptually relevant spatial information from the microphone array signals (e.g. directions of the arriving sound in frequency bands) are known.

Spatial audio capture (SPAC) involves using dynamic analysis of directional metadata (or directional information) derived from captured audio signals.

This information, often called the spatial metadata, may be applied to dynamically synthesize a spatial reproduction that is perceptually similar to the original recorded sound field.

Conventional audio signal capture has been performed using linear capture (classical, static) methods. These linear capture methods consist of non-adaptive beamforming techniques and includes Ambisonics which is a linear beamforming technique characterized by an intermediate signal representation in spherical harmonics. Linear techniques require extensive hardware for accurate spatial sound capture. For example, the Eigenmike (a sphere with 32 high-SNR-microphones) is satisfactory for linear reproduction.

Parametric audio signal capture (perceptual, adaptive) and spatial metadata analysis includes SPAC and any other adaptive methods, including Directional Audio Coding (DirAC), Harmonic plane wave expansion (Harpex), and other similar methods. These approaches analyse the microphone audio signals to determine spatial features such as directions of the arriving sound, typically adaptively in frequency bands. This determined parametric information enables perceptually accurate synthesis of the spatial sound. These parametric capture techniques have vastly lower SNR/hardware requirements than the linear techniques.

The aforementioned spatial capture methods are designed to be implemented on symmetrically or near symmetrical devices. However in many practical devices at least two of the dimensions (length, width, height) differ greatly from each other. For example, a device such as a smartphone or tablet may be flat towards a certain axis close to the horizontal plane.

This device asymmetry poses a problem for spatial capture. The main issue being that there is a 'short' spatial axis in the device which regardless of any optimization of the microphone positioning prevents any differential information between the microphones at this axis being large. As the differential information of the signals is small, the relative effect of any interferers (such as microphone self-noise, device noise, wind noise, vibration noise) is pronounced.

SUMMARY

There is provided according to a first aspect an apparatus comprising a predetermined shape, the apparatus comprising: at least three microphones, located on or within the apparatus, wherein at least one pair from the at least three microphones comprises two microphones which are separated by a shorter distance of the predetermined shape than at least one other microphone pair of the predetermined shape; and a processor configured to: receive at least three microphone audio signals from the at least three microphones; analyse at least the microphone audio signals from the two microphones which are separated by the shorter distance to determine a directional ambiguity decision; and analyse the microphone audio signals from at least one of the other microphone pairs to determine at least one sound characteristic other than the direction ambiguity, wherein the at least one of the other microphone pairs comprises two microphones separated by a longer distance along the predetermined shape in such a way that the first and the at least one of the other microphone pairs are configured to capture spatial audio signals.

The predetermined shape may be a physical shape of the apparatus.

At least one dimension of the physical shape of the apparatus may be shorter than other dimensions of the physical shape of the apparatus.

The two microphones which are separated by the shorter distance may be separated by the shorter distance due to the at least one dimension of the physical shape of the apparatus being shorter than other dimensions of the physical shape of the apparatus.

The predetermined shape may be a physical geometry of the at least three microphones.

The two microphones which are separated by the shorter distance may be located on a dimension other than at least one dimension of the physical shape of the apparatus shorter than other dimensions of the physical shape of the apparatus.

The processor configured to analyse at least the microphone audio signals from the two microphones which are separated by the shorter distance to determine a directional ambiguity decision may be further configured to analyse microphone audio signals from at least one of the other microphone pairs to determine the direction ambiguity decision.

The processor may be configured to determine a first spatial metadata part, the first spatial metadata part being the directional ambiguity decision; determine a second spatial metadata part, the second spatial metadata part being the at least one sound characteristic other than the direction ambiguity; and combine the first spatial metadata part and the second metadata part to generate spatial metadata associated with at least three microphone audio signals, and wherein the second metadata part has a greater range of values than the first metadata part.

The processor configured to analyse the microphone audio signals from at least one of the other microphone pairs to determine at least one sound characteristic other than the direction ambiguity may be configured to determine a delay value between the at least one of the other microphone pairs.

The at least one sound characteristic other than the direction ambiguity may be a direction angle of the arriving sound, wherein the direction angle has ambiguous values, and wherein the direction ambiguity decision resolves the ambiguous values.

The processor configured to analyse the microphone audio signals from at least one of the other microphone pairs to determine the direction angle may be configured to: determine a delay value between the microphone audio signals from at least one of the other microphone pairs; normalise the delay value against a delay value for a sound wave to travel a distance between the at least one of the other microphone pairs; apply a trigonometric function to the normalised delay value or use the normalised delay value in a look up table to generate at least two ambiguous direction angle values.

The processor configured to apply the trigonometric function to the normalised delay value to generate the at least two ambiguous direction angle values may be configured to apply an inverse cosine function to the normalised delay value to generate the at least two ambiguous direction angle values.

The processor configured to analyse at least the microphone audio signals from the two microphones which are separated by the shorter distance to determine a directional ambiguity decision may be configured to: determine a sign of a delay value associated with a maximum correlation value between the microphone audio signals from the two microphones which are separated by the shorter distance, wherein the processor may be further configured to resolve the at least two ambiguous direction angle values based on the sign of the delay value.

The processor configured to determine a delay value between the microphone audio signals may be configured to: determine a plurality of correlation values for a range of delay values between the microphone audio signals; search the plurality of correlation values for a correlation value with the maximum correlation value; and select the delay value from the range of delay values associated with the correlation value with the maximum correlation value.

The processor configured to determine a delay value between the microphone audio signals may be configured to: determine a derivative over frequency of a phase difference between the microphone audio signals; and determine the delay value based on the derivative over frequency of the phase difference.

The at least one sound characteristic other than the direction ambiguity may further comprise an energy ratio associated with the direction angle of the arriving sound.

The at least one sound characteristic other than the direction ambiguity may further comprise a coherence associated with the direction angle of the arriving sound.

The processor configured to analyse at least the microphone audio signals from the two microphones which are separated by the shorter distance to determine a directional ambiguity decision may be configured to analyse, on a frequency-band by frequency-band basis the at least the microphone audio signals from the two microphones which are separated by the shorter distance to determine a directional ambiguity decision.

The processor configured to analyse the microphone audio signals from at least one of the other microphone pairs to determine at least one sound characteristic other than the direction ambiguity may be configured to analyse, on a frequency-band by frequency-band basis, the microphone audio signals from at least one of the other microphone pairs to determine at least one sound characteristic other than the direction ambiguity.

The at least three microphones may comprise four microphones, the processor configured to receive at least three microphone audio signals from the at least three microphones may be configured to receive four microphone audio signals from the four microphones, the processor configured to analyse the microphone audio signals from at least one of the other microphone pairs to determine at least one sound characteristic other than the direction ambiguity may be configured to: analyse the microphone audio signals from at least two of the other microphone pairs to determine at least two delays; and determine an azimuth and elevation direction of an arriving sound from the at least two delays, and the processor configured to analyse at least the microphone audio signals from the two microphones which are separated by the shorter distance to determine a directional ambiguity decision is configured to determine a direction ambiguity decision for the determined azimuth and elevation direction. Although the direction values may be azimuth and elevation directions the direction values may be any suitable direction or co-ordinate system such as for example azimuth & inclination, unit vectors, etc.

According to a second aspect there is provided a method for an apparatus comprising a predetermined shape, the apparatus comprising: at least three microphones, located on or within the apparatus, wherein at least one pair from the at least three microphones comprises two microphones which are separated by a shorter distance of the predetermined shape than at least one other microphone pair of the predetermined shape, the method comprising: receiving at least three microphone audio signals from the at least three microphones; analysing at least the microphone audio signals from the two microphones which are separated by the shorter distance to determine a directional ambiguity decision; and analysing the microphone audio signals from at least one of the other microphone pairs to determine at least one sound characteristic other than the direction ambiguity, wherein the at least one of the other microphone pairs comprises two microphones separated by a longer distance along the predetermined shape in such a way that the first and the at least one of the other microphone pairs are configured to capture spatial audio signals.

The predetermined shape may be a physical shape of the apparatus.

At least one dimension of the physical shape of the apparatus may be shorter than other dimensions of the physical shape of the apparatus.

The two microphones which are separated by the shorter distance may be separated by the shorter distance due to the at least one dimension of the physical shape of the apparatus being shorter than other dimensions of the physical shape of the apparatus.

The predetermined shape may be a physical geometry of the at least three microphones.

The two microphones which are separated by the shorter distance may be located on a dimension other than at least one dimension of the physical shape of the apparatus shorter than other dimensions of the physical shape of the apparatus.

Analysing at least the microphone audio signals from the two microphones which are separated by the shorter distance to determine a directional ambiguity decision may further comprise analysing microphone audio signals from at least one of the other microphone pairs to determine the direction ambiguity decision.

The method may further comprise: determining a first spatial metadata part, the first spatial metadata part being the directional ambiguity decision; determining a second spatial metadata part, the second spatial metadata part being the at least one sound characteristic other than the direction ambiguity; and combining the first spatial metadata part and the second metadata part to generate spatial metadata associated with at least three microphone audio signals, and wherein the second metadata part has a greater range of values than the first metadata part.

Analysing the microphone audio signals from at least one of the other microphone pairs to determine at least one sound characteristic other than the direction ambiguity may comprise determining a delay value between the at least one of the other microphone pairs.

The at least one sound characteristic other than the direction ambiguity may be a direction angle of the arriving sound, wherein the direction angle has ambiguous values, and wherein the direction ambiguity decision resolves the ambiguous values.

Analysing the microphone audio signals from at least one of the other microphone pairs to determine the direction angle may further comprise: determining a delay value between the microphone audio signals from at least one of the other microphone pairs; normalising the delay value against a delay value for a sound wave to travel a distance between the at least one of the other microphone pairs; applying a trigonometric function to the normalised delay value or using the normalised delay value in a look up table to generate at least two ambiguous direction angle values.

Applying the trigonometric function to the normalised delay value to generate the at least two ambiguous direction angle values may comprise applying an inverse cosine function to the normalised delay value to generate the at least two ambiguous direction angle values.

Analysing at least the microphone audio signals from the two microphones which are separated by the shorter distance to determine a directional ambiguity decision may comprise: determining a sign of a delay value associated with a maximum correlation value between the microphone audio signals from the two microphones which are separated by the shorter distance, wherein the method further comprises resolving the at least two ambiguous direction angle values based on the sign of the delay value.

Determining a delay value between the microphone audio signals may comprise: determining a plurality of correlation values for a range of delay values between the microphone audio signals; searching the plurality of correlation values for a correlation value with the maximum correlation value; and selecting the delay value from the range of delay values associated with the correlation value with the maximum correlation value.

Determining a delay value between the microphone audio signals may comprise: determining a derivative over frequency of a phase difference between the microphone audio signals; and determining the delay value based on the derivative over frequency of the phase difference.

The at least one sound characteristic other than the direction ambiguity may further comprise an energy ratio associated with the direction angle of the arriving sound.

The at least one sound characteristic other than the direction ambiguity may further comprises a coherence associated with the direction angle of the arriving sound.

Analysing at least the microphone audio signals from the two microphones which are separated by the shorter distance to determine a directional ambiguity decision may comprise analysing, on a frequency-band by frequency-band basis the at least the microphone audio signals from the two microphones which are separated by the shorter distance to determine a directional ambiguity decision.

Analysing the microphone audio signals from at least one of the other microphone pairs to determine at least one sound characteristic other than the direction ambiguity may comprise analysing on a frequency-band by frequency-band basis, the microphone audio signals from at least one of the other microphone pairs to determine at least one sound characteristic other than the direction ambiguity.

The at least three microphones may comprise four microphones, wherein receiving at least three microphone audio signals from the at least three microphones may comprise receiving four microphone audio signals from the four microphones, analysing the microphone audio signals from at least one of the other microphone pairs to determine at least one sound characteristic other than the direction ambiguity may further comprise: analysing the microphone audio signals from at least two of the other microphone pairs to determine at least two delays; and determining an azimuth and elevation direction of an arriving sound from the two delays, and analysing at least the microphone audio signals from the at least two microphones which are separated by the shorter distance to determine a directional ambiguity decision may comprise determining a direction ambiguity decision for the determined azimuth and elevation direction.

A computer program product stored on a medium may cause an apparatus to perform the method as described herein.

An electronic device may comprise apparatus as described herein.

A chipset may comprise apparatus as described herein.

Embodiments of the present application aim to address problems associated with the state of the art.

SUMMARY OF THE FIGURES

For a better understanding of the present application, reference will now be made by way of example to the accompanying drawings in which.

EMBODIMENTS OF THE APPLICATION

Figure 1:
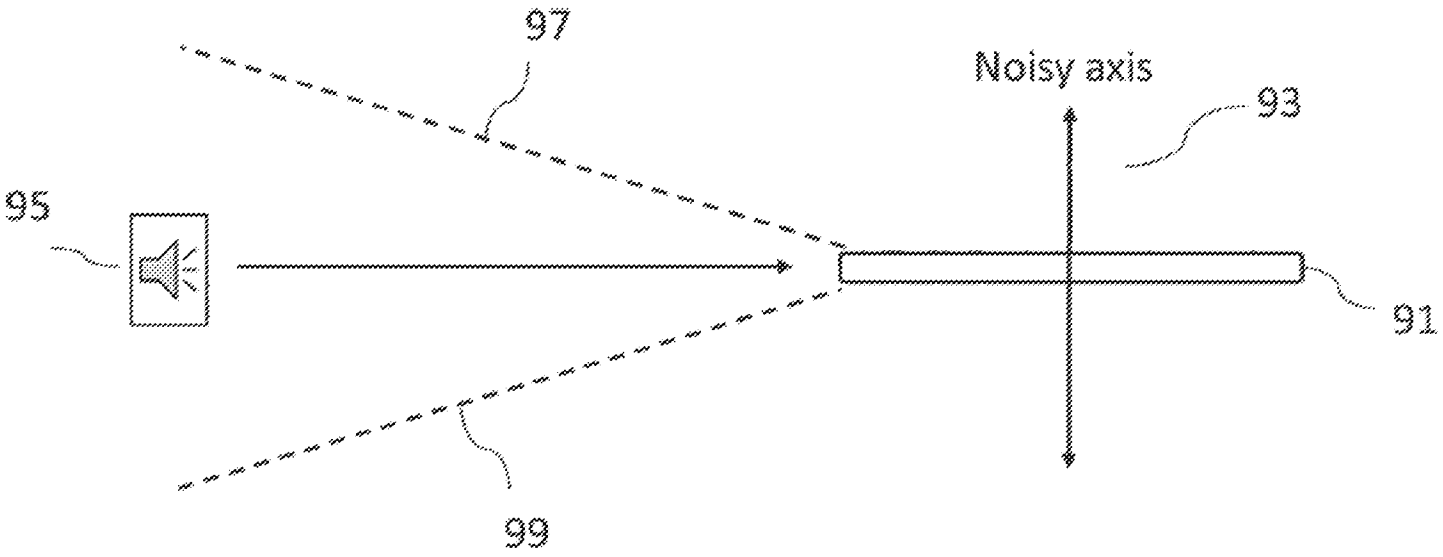
FIG. 1 shows spatial metadata errors caused by noise affecting a known spatial audio capture system.

The following describes in further detail suitable apparatus and possible mechanisms for the provision of effective spatial capture analysis suitable for implementing within asymmetric arrangements of microphones on devices. In the following examples, audio signals and audio capture signals are described. However it would be appreciated that in some embodiments the device or apparatus may be part of any suitable electronic device or apparatus configured to capture an audio signal or receive the audio signals and other information signals.

The following disclosure specifically describes adaptive SPAC techniques which represent methods for spatial audio capture from microphone arrays typically to loudspeakers or headphones. Spatial audio capture (SPAC) refers here to techniques that use adaptive time-frequency analysis and processing to provide high perceptual quality spatial audio reproduction from any device equipped with a microphone array, for example, Nokia OZO or a mobile phone. At least 3 microphones are required for SPAC capture in horizontal plane, and at least 4 microphones are required for 3D capture. The SPAC methods are adaptive, in other words they use non-linear approaches to improve on spatial accuracy from the state-of-the art traditional linear capture techniques.

Device asymmetry (where for example at least two of the dimensions such as length, width, height differ greatly from each other) poses a problem for linear capture and for conventional parametric spatial capture. The issue is primarily that the asymmetric configuration of the device creates a 'short' spatial axis. This 'short' spatial axis regardless of any optimization of the microphone positioning is one where differential information between the microphones is very small.

For example, Directional Audio Coding (DirAC) techniques in their typical form formulate the directional estimates based on the estimated sound field intensity vector. The intensity vector, in turn, is estimated from an intermediate spherical harmonic signal representation. The signals in the intermediate spherical harmonic signal representation are formulated based on the differences between the microphone signals. Since the amplitude of the differential information is small for the 'short' axis, the processing coefficients (or multipliers) to obtain the spherical harmonic signals at that axis have to compensate for the small amplitude. In other words, the multipliers are large in order to amplify the 'short' axis. The large multiplier or coefficient used to amplify the small amplitude also amplifies the noise. Therefore conventional approaches are subject to 'errors' produced by the noisy directional estimate at the 'short' axis.

For example, assuming a dry sound field with only a single source, noise in the directional estimate means that the sound reproduced using that metadata may not be accurately localized at its location. In such an example, the sound could be perceived as being 'blurry' and only approximately arriving from the correct direction. In other words the sound reproduction may not be able to represent the single source as a point source.

The effect of the variation of a directional estimate may for example be shown in FIG. 1. FIG. 1, for example, shows an example asymmetric apparatus 91 which has a 'short' dimension from front to back of the apparatus and furthermore shows noise being received from a 'noisy' axis 93 in the same direction as the 'short' dimension. Any arriving sound, for example a sound represented by the loudspeaker symbol 95, which is primarily located perpendicular to the 'short' dimension is particularly susceptible to all sources of noise, pronouncing the parameter estimation errors when the spatial metadata associated with the captured sound is determined. This is shown, for example in FIG. 1 by the dashed lines 97 and 99 showing the large effect the noise on the 'noisy' axis 93 has to the estimated directional parameters.

Thus there is a need for a spatial metadata analysis method which accounts for any asymmetric apparatus shape or irregular device shape.

In the following the apparatus is described as having a predetermined shape. The predetermined shape may refer to the physical shape or dimensions of the apparatus or may refer to the physical geometry of arrangement of the microphones on or in the apparatus. In some embodiments the physical shape of the apparatus may not be asymmetric, but the arrangement of the microphones on the apparatus is asymmetric.

The concept as discussed hereafter is the implementation of parametric spatial audio capturing which is adapted with respect to the capture device shape. A relevant capture device may be characterized by a small microphone spacing dimension. For example typically a smart phone, a tablet, a hand-held VR camera, where the at least one of the dimensions of the device limit the option to have reasonable spatial separation of microphones for all axes of interest. As discussed previously typical parametric techniques for spatial audio capture fail with the above condition. For example, DirAC (and its variants, for example Higher-Order DirAC) as well as Harpex use an intermediate B-format (or more generally: spherical harmonic) signal representation. While it is theoretically possible to arrive at a spherical harmonic signal representation from a near-flat device, the spherical harmonic signals for one axis have a very low SNR due to the microphone distances. This noise makes the spatial analysis on that axis unstable.

Furthermore an additional property of the parametric capturing is that any technique using an intermediate spherical harmonic (or similar) representation can only produce spatial reproduction below the spatial aliasing frequency. This is the frequency above which the spherical harmonic signal cannot be formed due to too small audio wavelength with respect to the microphone spacing. Above the spatial aliasing frequency using spherical devices such as OZO it can be possible to use acoustic shadowing information to determine directional information. However acoustic shadowing information may not be reliable on apparatus such as a mobile phone, where the acoustic shadowing is not prominent on all axes and may also vary depending on how the user is holding the apparatus. A further benefit of the examples described herein is that they function both below and above the spatial aliasing frequency.

The concept may be implemented in some embodiments within a device with 3 or more microphones. With at least 3 microphones horizontal surround metadata may be analysed. With at least 4 microphones height metadata may also be analysed. The spatial metadata may be information which can be utilized by the device or apparatus directly, or may be transmitted to a receiver device. An apparatus (for example apparatus receiving the spatial metadata) may then use the spatial metadata and audio signals (which may be other than the original microphone signals) to synthesize a desired output to synthesize the spatial sound to be output for example over headphones or for loudspeakers without knowledge of the microphone locations and/or dimensions of the capture apparatus. For example, a capture device may have several microphones, but stores/transmits only two of the channels, or combines linearly or adaptively the several channels for transmission, or processes the channels (equalization, noise-removal, dynamic processing . . . ) before transmitting the audio signals alongside the spatial metadata.

These can be received by the further apparatus which processes the audio signals using the spatial metadata (and in some embodiments further inputs such as head orientation) to determine a synthesised audio output signal or signals.

A common factor in embodiments described herein is that spatial metadata and some audio signals originating in a way or another from the same or similar sound field are utilized at the synthesis stage (this utilization may be either directly, or after transmission/storing/encoding, etc).

The core concept associated with the embodiments described herein is one where the capture device is configured to have at least one axis of capture which is selected to perform only directional ambiguity (also known as front-back) audio analysis, typically in frequency bands. This axis of capture is such that the delay between audio signals generated by microphones from an arriving plane wave along that axis has a value which is smaller than the maximum delay between audio signals generated by microphones defining another capture axis. An example of such an axis is shown in FIG. 2*a*.

Figure 2A:
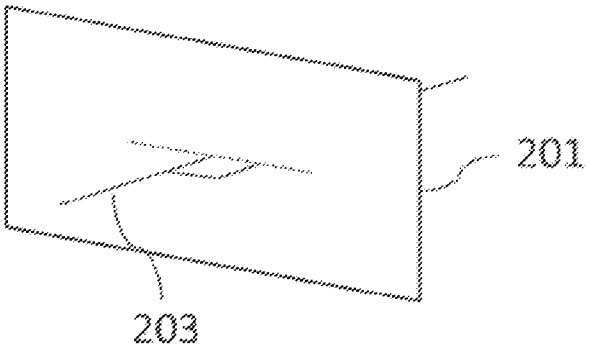
FIGS. 2*a* and 2*b* show schematically asymmetric microphone arrangement audio capture and processing apparatus suitable for implementing some embodiments.

FIG. 2*a* shows an example device 201 with the 'short' dimension axis 203. The 'short' axis 203 of the device 201 (for example a thickness of a tablet device) along which a microphone spacing is significantly smaller than from another axis. In the embodiments as described herein this 'short' dimension axis 203 is selected for direction ambiguity analysis only. In such a manner any selected 'short' dimension axis may prevent the generation of lower quality spatial metadata when generating accurate spatial information but enable the generation of robust direction ambiguity choice (for example whether the sound arrives from the front or the back direction related to that axis) spatial information. The direction ambiguity choice may be binary, e.g., if the sound arrives from one or the other side of the device. The direction ambiguity choice may have more than two choices, nevertheless, the direction ambiguity choice substantially is more a 'selection' parameter when compared to the fine angular determination parameter that is obtained from the delay or other analyses based on the signal analysis at the 'non-thin' axes.

Figure 2B:
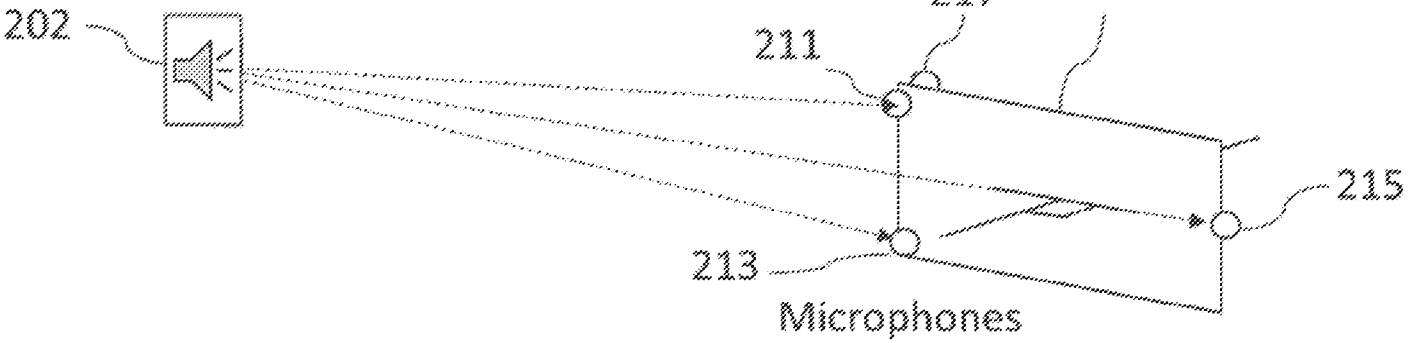

As shown in FIG. 2*b*, the example apparatus or device 201 may comprise four microphones. The arrangement of the microphones shown in FIG. 2*b* is an example only of an arrangement of microphones for demonstrating the concept of the invention and it is understood that the microphones may be arranged in any suitable distribution. In the example shown in FIG. 2*b* three of the microphones are located to the 'front' of the device and one microphone is located to the 'rear' of the device 201. Furthermore a first of the 'front' microphones 211 may be located at one corner of the device 201, a second of the 'front' microphones 213 may be located at an adjacent corner of the device 201, and a third of the 'front' microphones 215 may be located in the middle of the side opposite to the side between the first 211 and second 213 microphones of the device 201. The 'rear' microphone 217 is shown in FIG. 2*b* located at the same corner as the first 'front' microphone but on the opposite face to the first 'front' microphone 211. It is understood that the terms 'front' and 'rear' are relative terms to the user of the apparatus and as such have been chosen as examples only.

The arrangement of the microphones on the example device 201 is such that an arriving sound 202 towards the front of the device may be captured by the 'front' microphones as first to third audio signals at the first to third microphones respectively. Spatial metadata may then be generated by analysis of the first to third audio signals. In some embodiments the dimensions of the microphone placement or microphone positions thus enables the selection of the type of analysis to be performed on the audio signals. For example the distance between the microphones 211 and 215 (or the microphones 211 and 213, or the microphones 213 and 215) is such that a robust analysis may be performed (for example directional analysis and therefore the direction of the arriving sound 202 with respect to the device 201) may be determined by delay analysis of the audio signals, whereas the distance between the microphones 211 and 217 is such that a directional ambiguity (for example 'front-back') decision analysis may be performed.

In some embodiments the spatial metadata comprises at least one sound characteristic (other than direction) which may be determined from the analysis of the at least one microphone pair audio signals. For example in some embodiments cross-correlation analysis of the microphone pair which has the largest mutual distance can be performed to determine an energy ratio parameter, that indicates the estimated proportion of the sound energy arriving from the determined 'source' direction with respect of all sound energy captured by the device in that frequency band. In some embodiments the remainder of the sound energy may be determined to be non-directional (for example reverberation sound energy).

The spatial metadata such as sound direction together with the energy ratio in frequency bands are parameters that express the perceptually relevant spatial information of the captured sound, and which can be utilized to perform high-quality spatial audio synthesis in a perceptual sense. The approach of using only a directional ambiguity choice in a thin axis of the device, and determining the most of the spatial information from the other axis/axes of the device, enables that even highly asymmetric devices can be used to capture this generalized spatial information. A spatial audio player (for example a player as described in European patent application EP2617031A1) can use the spatial information during playback to synthesize a suitable spatial audio signal (binaural, multichannel) without any extra knowledge of the capture device size or microphone locations.

Figure 3:
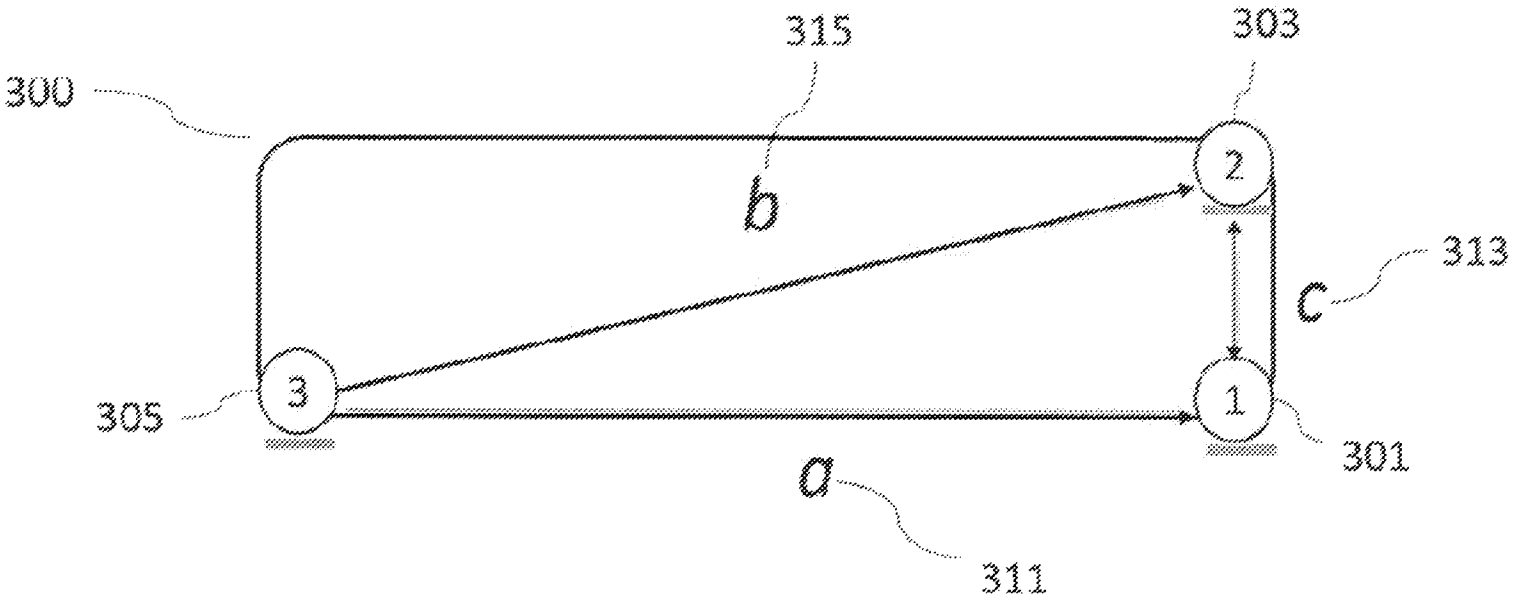
FIG. 3 shows schematically a three microphone asymmetric arrangement audio capture and processing apparatus suitable for implementing some embodiments.

With respect to FIG. 3 an example device 300 is shown in which 3 microphones are placed on a device that constrains the microphone placement in at least in one axis as described previously. The example device 300 may, for example, represent a mobile device which has two 'forward' facing microphones, microphone 1 301 and microphone 3 305 and one 'rear' facing microphone, microphone 2 303. The shape of the device is such that the distance between microphone 1 301 and microphone 2 303 is defined by distance 'c' 313 along a 'short' axis of the device whereas the distance between the microphone 1 301 and microphone 3 305 is defined by distance 'a' 311 along a 'long' axis of the device. The distance between the microphone 2 303 and microphone 3 305 is defined by distance 'b' 315 which is the diagonal of the 'short' and 'long' axis of the device. In other words the distances 'a' 311 and 'c' 313 differ significantly.

In some embodiments when performing analysis on the audio signals from the microphones in order to determine the spatial metadata the microphones (and thus the audio signals generated by the microphones) microphone 1 301 and microphone 2 303 separated by the 'short' axis are selected such that only directional ambiguity or 'front-back' analysis is performed on these audio signals. For example delay analysis between the audio signals from microphone 1 301 and microphone 2 303 will result in noisy output values when determining directional information associated with a sound. However, the same delay analysis may, with fair robustness, be used to estimate whether a sound arrives first to microphone 1 301 or microphone 2 303, providing the 'front-back' directional ambiguity information.

The microphones (and thus the audio signals generated by the microphones) microphone 1 301 and microphone 3 305 separated by the 'long' axis may form a pair (separated by distance a) with a relatively large distance between the microphones. The pair of microphones microphone 1 301 and microphone 3 305 could therefore be used to detect spatial direction information with higher robustness. For example, the delay-analysis between microphones 1 301 and 3 305 could provide information that can estimate the direction of the arriving sound at the horizontal plane.

As there are only two microphones in the direction detection analysis pair (microphone 1 301 and microphone 3 305), the direction analysis produces a result which is ambiguous. The same delay information would be obtained for a situation where the sound from the source arrives from the 'front' side or the 'back' or 'rear' side of the device at an approximately (or exactly) mirror-symmetric angle (depending on the microphone positioning and acoustic properties of the device). This ambiguity can be solved using the front-back information from the 'short' distance pair of microphone 1 301 and microphone 2 303.

Figure 4:
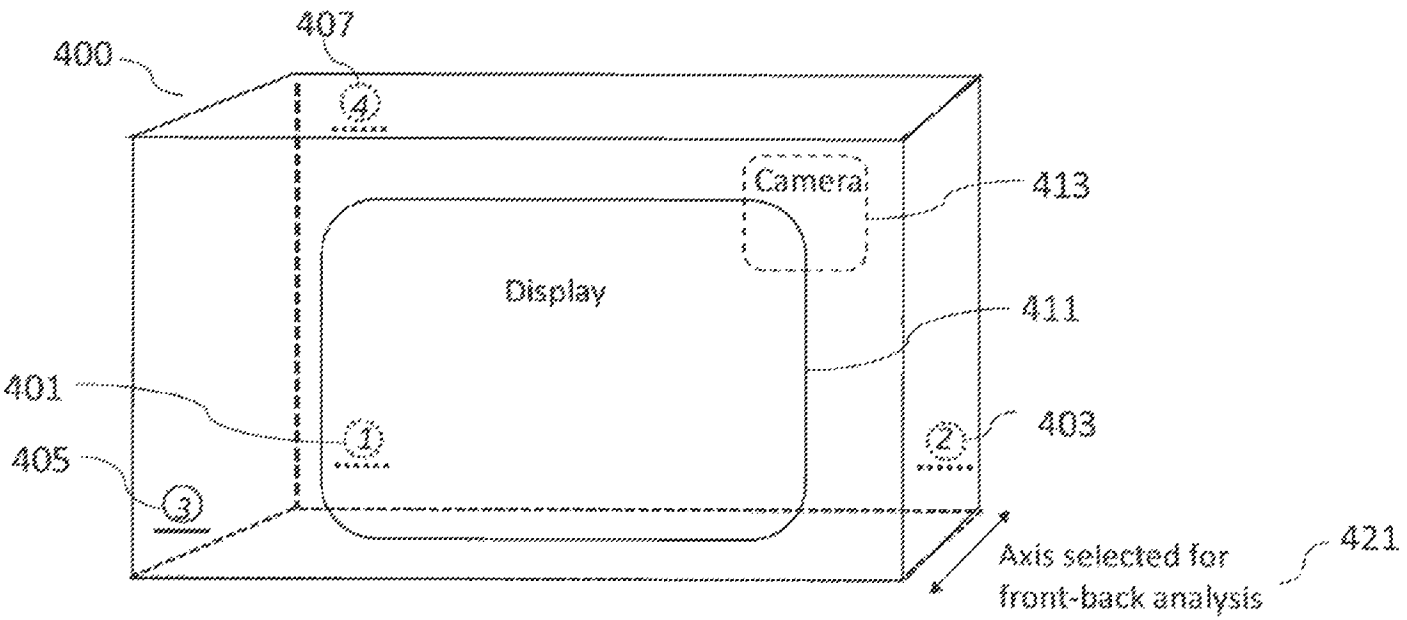
FIG. 4 shows schematically a four microphone asymmetric arrangement audio capture and processing apparatus suitable for implementing some embodiments.

FIG. 4 furthermore shows a further example device with four microphones. In this further example device as shown in FIG. 4 the 'rear' or 'back' face of the device is shown fully. On the 'rear' face is located a microphone 3 405 in one corner and the display 411 centrally on the 'rear' face. The 'rear' face shows two of the 'long' axes in the form of the length and width of the device. The opposite 'front' face of the device 400 shows in dashed form a camera 413. The 'front' face furthermore has located on it a microphone 1 401 which is located opposite the microphone 3 405 but located on the 'front' face of the device 400. In such a configuration the distance between the microphone 1 401 and the microphone 3 405 is the thickness of the device (which is considered to be the 'short' axis of the device 400). On the 'front' face but located at an adjacent corner separated by the device width is the microphone 2 403. Furthermore on the 'front' face but located at an adjacent corner separated by the device height is the microphone 4 407. In this example devices with 4 microphones as well as a directional spatial metadata determination, height directional information can be determined.

In this example device the microphone spacing is smaller for the thickness axis 421 than for the height or width axes. As such the microphone pairing between. microphone 1 401 and microphone 3 405 is such that the audio signals from this selection are to be used for delay analysis as described earlier for the directional ambiguity front-back analysis only.

Figure 5:
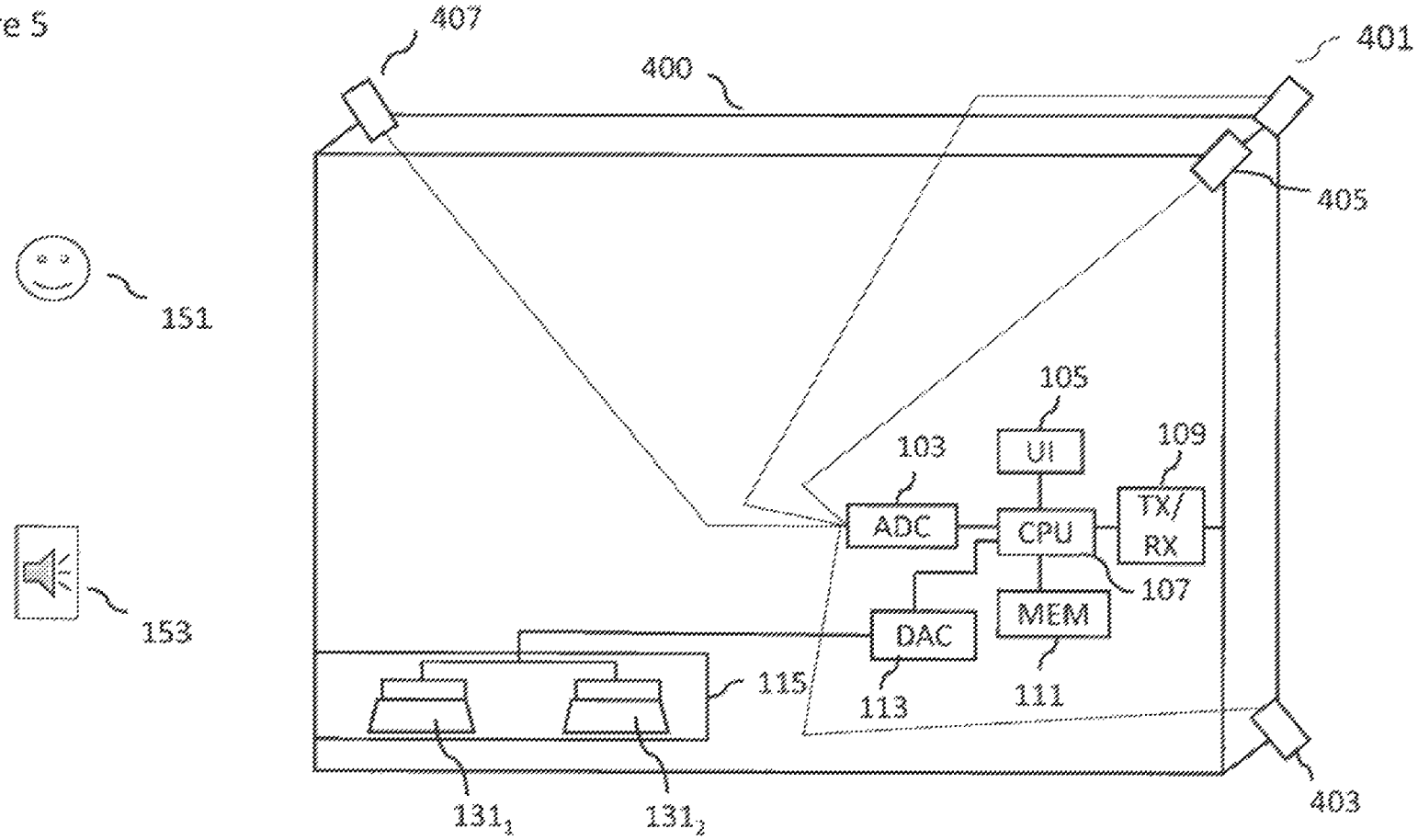
FIG. 5 shows schematically functional processing elements of the example audio capture and processing apparatus suitable for implementing some embodiments

FIG. 5 shows an example of internal components of the example audio capture apparatus or device shown in FIG. 4 suitable for implementing some embodiments. The audio capture apparatus 100 comprises the microphones (which may be defined as being microphones within a microphone array). The microphone array in the example shown in FIG. 5 shows microphones 401 to 407 organised in a manner similar to that shown in FIG. 4.

The microphones 401, 403, 405, 407 are shown configured to convert acoustic waves into suitable electrical audio signals. In some embodiments the microphones are capable of capturing audio signals and each outputting a suitable digital signal. In some other embodiments the microphones or array of microphones can comprise any suitable microphone or audio capture means, for example a condenser microphone, capacitor microphone, electrostatic microphone, Electret condenser microphone, dynamic microphone, ribbon microphone, carbon microphone, piezoelectric microphone, or microelectrical-mechanical system (MEMS) microphone. The microphones can in some embodiments output the audio captured signal to an analogue-to-digital converter (ADC) 103.

The audio capture apparatus 400 may further comprise an analogue-to-digital converter 103. The analogue-to-digital converter 103 may be configured to receive the audio signals from each of the microphones and convert them into a format suitable for processing. In some embodiments the microphones may comprise an ASIC where such analogue-to-digital conversions may take place in each microphone. The analogue-to-digital converter 103 can be any suitable analogue-to-digital conversion or processing means. The analogue-to-digital converter 103 may be configured to output the digital representations of the audio signals to a processor 107 or to a memory 111.

The audio capture apparatus 100 electronics can also comprise at least one processor or central processing unit 107. The processor 107 can be configured to execute various program codes. The implemented program codes can comprise, for example, signal delay analysis, spatial metadata processing, signal mixing, phase processing, amplitude processing, decorrelation, mid signal generation, side signal generation, time-to-frequency domain audio signal conversion, frequency-to-time domain audio signal conversions and other algorithmic routines.

The audio capture apparatus can further comprise a memory 111. The at least one processor 107 can be coupled to the memory 111. The memory 111 can be any suitable storage means. The memory 111 can comprise a program code section for storing program codes implementable upon the processor 107. Furthermore, the memory 111 can further comprise a stored data section for storing data, for example data that has been processed or to be processed. The implemented program code stored within the program code section and the data stored within the stored data section can be retrieved by the processor 107 whenever needed via the memory-processor coupling.

The audio capture apparatus can also comprise a user interface 105. The user interface 105 can be coupled in some embodiments to the processor (CPU) 107. In some embodiments the processor 107 can control the operation of the user interface 105 and receive inputs from the user interface 105. In some embodiments the user interface 105 can enable a user to input commands to the audio capture apparatus 400, for example via a keypad. In some embodiments the user interface 105 can enable the user to obtain information from the apparatus 400. For example, the user interface 105 may comprise a display configured to display information from the apparatus 400 to the user. The user interface 105 can in some embodiments comprise a touch screen or touch interface capable of both enabling information to be entered to the apparatus 400 and further displaying information to the user of the apparatus 400.

In some implements the audio capture apparatus 400 comprises a transceiver 109. The transceiver 109 in such embodiments can be coupled to the processor 107 and configured to enable a communication with other apparatus or electronic devices, for example via a wireless or fixed line communications network. The transceiver 109 or any suitable transceiver or transmitter and/or receiver means can in some embodiments be configured to communicate with other electronic devices or apparatus via a wireless or wired coupling.

The transceiver 109 can communicate with further apparatus by any suitable known communications protocol. For example in some embodiments the transceiver 109 or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

The audio capture apparatus 400 may also comprise a digital-to-analogue converter 113. The digital-to-analogue converter 113 may be coupled to the processor 107 and/or memory 111 and be configured to convert digital representations of audio signals (such as from the processor 107) to a suitable analogue format suitable for presentation via an audio subsystem output. The digital-to-analogue converter (DAC) 113 or signal processing means can in some embodiments be any suitable DAC technology.

Furthermore the audio subsystem can comprise in some embodiments an audio subsystem output 115. An example as shown in FIG. 5 is a pair of speakers $\mathbf{131}_1$ and $\mathbf{131}_2$. The speakers 131 can in some embodiments be configured to receive the output from the digital-to-analogue converter 113 and present the analogue audio signal to the user. In some embodiments the speakers 131 can be representative of a headset, for example a set of earphones, or cordless earphones.

Furthermore the audio capture apparatus 400 is shown operating within an environment or audio scene wherein there are multiple arriving sounds present. In the example shown in FIG. 5 the environment comprises a first sound 151, a vocal source such as a person talking at a first location. Furthermore the environment shown in FIG. 5 comprises a second sound 153, an instrumental source such as a trumpet playing, at a second location. The first and second locations for the first and second sounds 151 and 153 respectively may be different. Furthermore in some embodiments the first and second sounds may generate audio signals with different spectral characteristics.

Although the audio capture apparatus 400 is shown having both audio capture and audio presentation components, it would be understood that the apparatus 400 can comprise just the audio capture elements such that only the microphones (for audio capture) are present. Similarly in the following examples the audio capture apparatus 400 is described being suitable to performing the spatial audio signal processing described hereafter. The audio capture components and the spatial signal processing components may also be separate. In other words the audio signals may be captured by a first apparatus comprising the microphone array and a suitable transmitter. The audio signals may then be received and processed in a manner as described herein in a second apparatus comprising a receiver and processor and memory.

Figure 6:
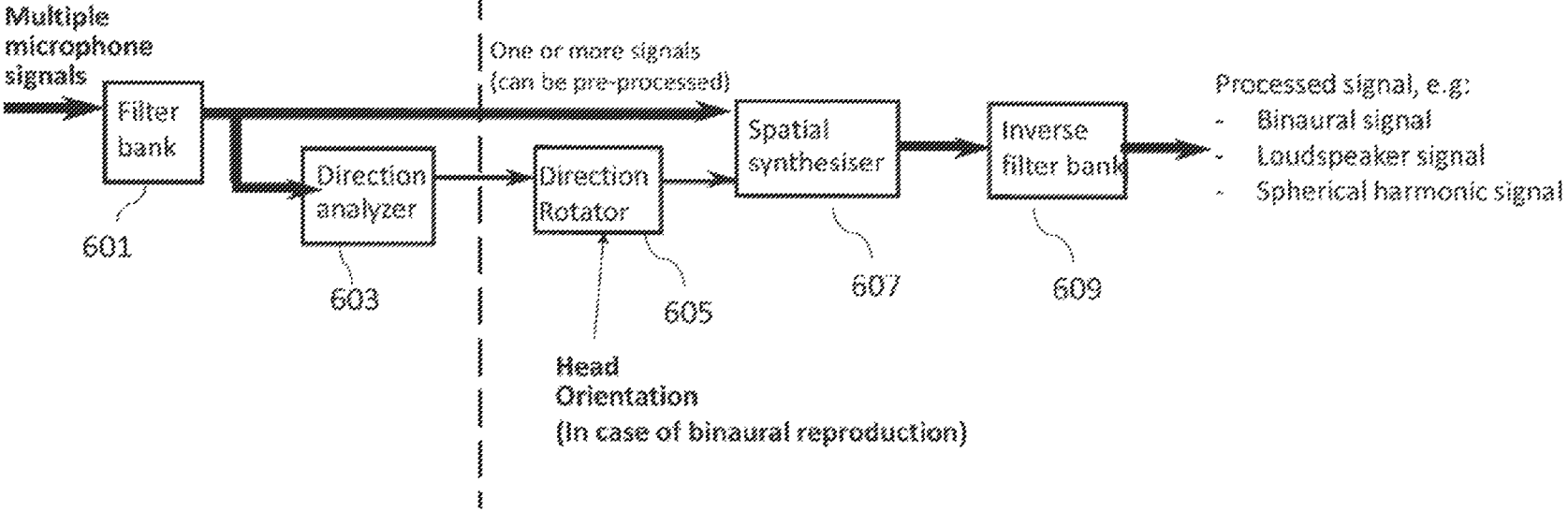
FIG. 6 shows schematically functional elements of the analyser as shown in FIG. 5 according to some embodiments.

FIG. 6 is a schematic block diagram illustrating processing of signals from multiple microphones to output signals on two channels. Other multi-channel reproductions are also possible. In addition to input from the microphones, input regarding head orientation can be used by the spatial synthesis.

For the sound capture, processing and reproduction, the components can be arranged in various different manners.

According to a possibility everything left of the dashed line takes place in the capture device, and everything right of the dashed line takes place in a viewing/listening device, for example a head mounted display with headphones, a tablet, mobile phone, laptop and so on. The audio signals and directional metadata may be coded/stored/streamed/transmitted to the viewing device. In some embodiments the apparatus is configured to generate a stereo or other one or more channel audio track that is transmitted along the spatial metadata. The stereo track (or other) in some embodiments may be a combination or subset of the microphone signals. Although not shown in FIG. 6, in some embodiments the audio track can be encoded e.g. using AAC for transmission or storage, and the spatial metadata from the direction analyser 603 can be embedded to the AAC metadata. The AAC (or other) audio and the spatial metadata can also be combined to a media container such as an mp4 container, possibly with a video track and other information. Although not shown in the FIG. 6, in the decoder side the transmitted encoded audio and metadata, being an AAC or mp4 stream or other, can be decoded to be processed by the spatial synthesizer 607. The aforementioned processing may involve usage of different filter banks such as a forward and an inverse filter bank and a forward and an inverse modified discrete cosine transform (MDCT), or other necessary processes typical to audio/video encoding, multiplexing, transmission, demultiplexing and decoding.

In some optimized implementations the apparatus, or more specifically the spatial synthesizer 607, may be configured to separate direct and ambient audio parts or any other signal components for spatial synthesis to be processed separately. In other embodiments the direct and ambient parts or any other signal components can be synthesized from the audio signals at a single unified step using for example adaptive signal mixing and decorrelation. In other words, there are various means to process the sound according to the spatial metadata to obtain the desired spatialized audio output.

According to a possibility all processing takes place in the capture device which may be the device shown in FIGS. 3 to 5. The capture device can comprise a display and a headphone connector/speaker for viewing the captured media. The audio signals and directional information, or the processed audio output according to the audio signals and the directional information, can be coded/stored in the capture device.

The capture device may for example comprise a filter bank 601 configured to receive the multiple microphone signals and output a transformed domain signal to a spatial synthesizer 607 and to a direction analyser 603. The filter bank may be any suitable filter bank implementation such as short time Fourier transform (STFT) or complex QMF bank. The direction analyser 603 may be configured to receive the audio signals from the filter bank and perform delay analysis in a manner such as described herein in order to determine spatial metadata associated with the audio scene. This information may be passed to the spatial synthesizer 607 and to a direction rotator 605. In some embodiments the capture device comprises a spatial processor such as a direction rotator 605. The direction rotator may be configured to receive the directional information determined within the direction analyser 603 and 'move' the directions based on a head orientation input. The head orientation input may indicate a direction the user is looking and may be detected using for example a head tracker in a head mounted device, or accelerometer/mouse/touchscreen in a mobile phone, tablet, laptop etc.

The output 'moved' spatial metadata may be passed to the spatial synthesiser 607. The spatial synthesiser 607 having received the audio signals from filterbank 601 and spatial metadata from the direction analyser 603 and the direction rotator 605 may be configured to generate or synthesise a suitable audio signal.

The output signals can be passed in some form (for example coded/stored/streamed/transmitted) to the viewing device.

According to a possibility all processing takes place in the viewing device. The microphone signals as such are coded/stored/streamed/transmitted to the viewing device that performs the processing as described in FIG. 6. The output of the inverse filter bank 609 may be configured to be output by any suitable output means such as speakers/headphones/earphones.

Figure 7:
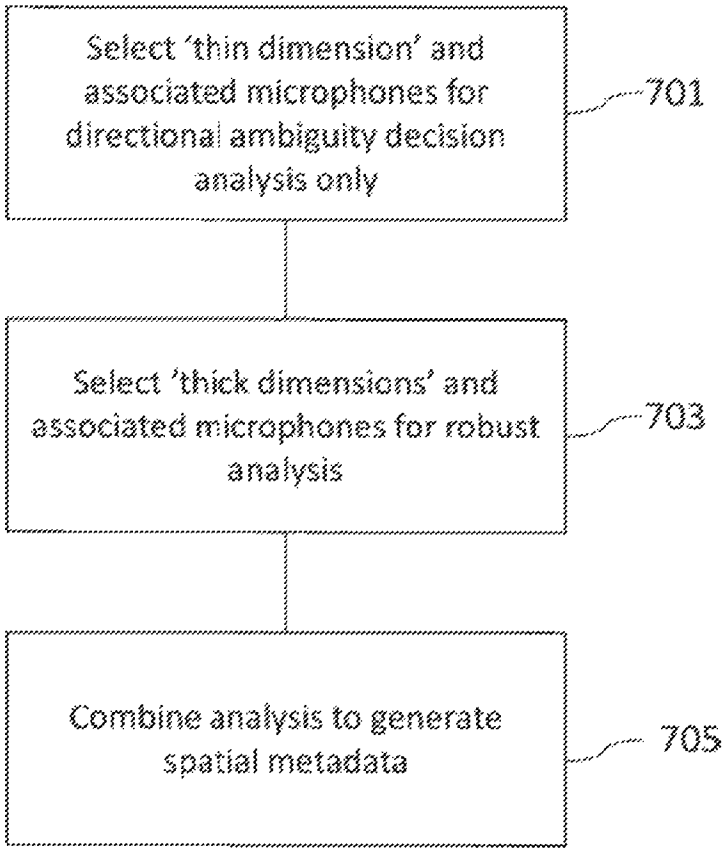
FIG. 7 shows a flow diagram of an axis based analysis operation as implemented within apparatus as shown in FIG. 6 according to some embodiments.

With respect to FIG. 7 a flow diagram showing the operation of direction analyser 603 as shown in FIG. 6 or more generally a spatial metadata analyser implemented within an example capture or processing device is described in further detail.

The device (and in some embodiments the spatial metadata analyser/direction analyser) is shown selecting a first microphone arrangement associated with a 'thin' axis. The first microphone arrangement may be a pair or more than two microphones which substantially define a dimension or axis. In some embodiments the device is configured to select a dimension or an axis and from this selected dimension or axis determine which microphone audio signals to use for the later analysis. For example a dimension or axis may be chosen which does not have two microphones aligned and thus a 'synthesised' microphone may be generated by combining the audio signals.

In some embodiments an estimate of a group of delays between a selection of microphones may be performed, and the delay information from more than one pair may be used to determine the directional ambiguity 'front-back' choice. The rule to combine the several delay estimates to obtain the directional ambiguity choice can be heuristic (using hand-tuned formulas), or optimized (e.g. using least squares optimization algorithms) based on measurement data from the devices.

The delay information between the audio signals from the selected microphone arrangement may be configured to be used to determine a first spatial metadata part. The first spatial metadata part may for example in some embodiments be a directional ambiguity analysis (such as the front-back determination).

The operation of selecting a thin axis and an associated microphone arrangement and using the delay information from the selected microphone arrangement audio signals to determine directional ambiguity information only is shown in FIG. 7 by step 701.

The device (and in some embodiments the spatial metadata analyser/direction analyser) is shown selecting a further microphone arrangement. The further microphone arrangement may be a further pair or more than two microphones which substantially define a dimension or axis other than the 'thin' axis (i.e. the 'thick axes' or 'thick dimensions').

In some embodiments this further selection is all microphone axis or dimensions other than the 'thin' axis.

The delay information between the audio signals from the further selection may be configured to be used to determine a second spatial metadata part. The second spatial metadata part may for example in some embodiments be a robust directional estimate. Furthermore in some embodiments the first spatial metadata part may further include directional ambiguity directional estimates (such as the front-back determination).

The operation of selecting further selections of microphones and using the delay information from the selected microphone audio signals is shown in FIG. 7 by step 703.

The system may then combine the first and second spatial metadata parts in order to produce robust metadata output. For example the directional information from the further arrangement of microphone audio signals and the directional ambiguity detection from the first arrangement of microphone audio signal may generate a robust and unambiguous directional result.

Although the example shown in FIG. 7 shows a microphone system which generates a first and second selection this may be extended to further selections which may for example define both vertical and horizontal plane examples.

The operation of determining a combined spatial metadata output from the first and second spatial metadata parts is shown in FIG. 7 by step 705.

Figure 8:
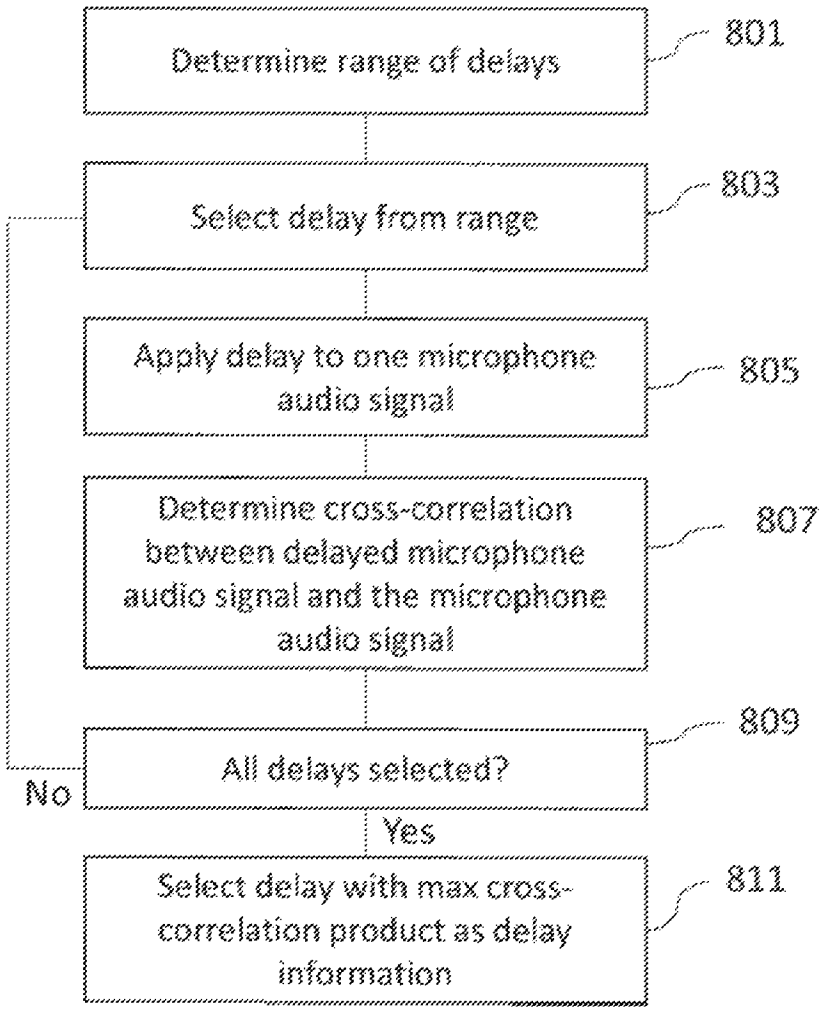
FIG. 8 shows a flow diagram of an example delay information determination operation as implemented within apparatus as shown in FIG. 6 according to some embodiments.

With respect to FIG. 8 a first example of delay analysis suitable for use in embodiments is shown. In the following example the delay analysis is performed on single frequency band of the audio signals. It is understood that in some embodiments where the analysis is performed on a band-by-band basis then these operations may be performed on a band-by-band basis also.

The device (and in some embodiments the spatial metadata analyser/direction analyser) is configured in some embodiments to apply a 'search' method for determining the delay between audio signals generated by pairs of microphones. In the 'search' method a cross correlation product between the audio signals captured by the pair of microphones at a set of different delays is determined. The delay with the maximum cross correlation can then be selected as the estimated delay.

This may be implemented for example in the following manner. However in some embodiments any suitable search method may be used to determine the delay with the maximum cross correlation.

First a range of delays is determined. The range of delays may include both negative and positive delays.

The operation of determining a range of delays is shown in FIG. 8 by step 801.

Then a delay is selected from the range of delays.

The operation of selecting a delay from the range of delays is shown in FIG. 8 by step 803.

The delay is then applied to one of the microphone audio signals. The delay may be applied as adjustments of the phase in the frequency domain, which is an approximation of the delay adjustment.

The operation of applying a delay to one of the microphone audio signals is shown in FIG. 8 by step 805.

A cross-correlation product is then determined for the un-delayed microphone audio signal and the delayed microphone audio signal.

The operation of determining a cross-correlation product for the pair of audio signals is shown in FIG. 8 by step 807.

The method then checks to determine whether all of the delays has been selected. Where there are still delays within the range of delays then the method passed back to step 803 where a further delay value is selected from the range of delays.

The operation of checking whether all of the delays have been selected is shown in FIG. 8 by step 809.

Where all of the delays have been selected from the range then the delay with the maximum cross-correlation product value is selected as the delay information value.

The operation of selecting the maximum cross-correlation product value is shown in FIG. 8 by step 811.

A further example of the determination of the delay information may be a phase derivative method for determining the delay information value. In this phase derivative method a delay between microphones is determined which corresponds to the derivative over frequency of the phase difference between the microphones. Thus by estimating this phase derivative the estimate of the delay may be provided.

In other embodiments any suitable method for determining the delay information between selected pairs of microphone audio signals may be implemented in order to obtain the delay information.

In some embodiments having determined the delay information this delay information can be used to determine the spatial metadata.

For example with respect to the example three microphone device shown in FIG. 3, the selected pair of microphones microphone 1 301 and microphone 3 305 may be sufficiently spatially separated that the delay information may be used to determine the directional or angular information by first normalizing the delay parameter with a maximum-delay parameter (formulated based on the microphone distance between the microphone pairs and a speed of sound) to obtain a normalized delay $d_{norm}$ that is constrained between −1 and 1. The maximum normalized delay is obtained when the sound arrives from the axis defined by the pair or microphones. The angular information may then be obtained for example by $\mathrm{acos}(d_{norm})$.

With respect to the same device shown in FIG. 3, the selected pair of microphones microphone 1 301 and microphone 2 303 may not be sufficiently spatially separated to perform directional analysis. However the delay information from this pair of microphone audio signals may be able to provide a directional ambiguity decision (the 'front-back' decision) which can be determined from the sign of the normalised delay parameter. In such a manner combining the front-back information and the angular information provides the direction of the arriving sound at the horizontal plane.

In some embodiments it is possible to determine spatial metadata characteristics other than direction. For example a ratio parameter indicating the proportion of the sound energy arriving from the analysed direction may be determined from a coherence parameter calculated between the microphone audio signals. Only a directional sound is coherent (although potentially differently delayed) between the microphones, whereas a non-directional sound can be incoherent at some frequencies, or partially coherent at lower frequencies. Thus by performing a correlation analysis a ratio parameter of the analysed sound can be provided.

In the embodiments described herein the correlation determination may be performed on the thin axis and non-thin axis selected microphone arrangement audio signals. The determination of the ratio parameter is typically preferable to be performed using the correlation determination on the non-thin axis selected microphone arrangement audio signals. This is because a pair of microphones with a larger distance will have larger differences between correlations of the directional sound and non-directional sound. In some embodiments the normalized complex-valued cross-correlation between channels 1 and 3 may be expressed as $C_{13}$ $$C_{13} = \frac{E[x_1 x_3^*]}{E[|x_1|]E[|x_3|]},$$

where E[ ] denotes an expectation operator, typically implemented using an average or a sum operation, and the asterisk denotes complex conjugate. The audio signals x are complex-valued frequency band signals where the subscript indicates the microphone source of the audio signal.

Furthermore other methods can be used to estimate the direct-to-total energy ratios (or similar), for example using the stability of the directional estimate.

In case of the device shown in FIG. 4 with 4 microphones, height directional information can also be determined. As described previously the device thickness defines the 'thin' axis microphone spacing compared to the height or width axes. As such any microphone arrangement which is separated by only the thickness axis is selected to only be suitable for determining directional ambiguity spatial metadata (for example 'front-back' analysis).

Thus for example in FIG. 4, the microphone pair defined by microphone 1 401 and microphone 3 405 which is separated by this 'thin' axis is selected such that it is a 'directional ambiguity' microphone arrangement selection, and any analysis performed on the audio signals from this selection of microphones is a 'directional ambiguity' analysis. Other microphone selections such as microphone 1 401 and microphone 2 403 (or microphone 1 401 and microphone 4 407) which are separated by a distance more than the 'thin' axis may be selected to perform delay analysis to determine directional (or other robust) parameters.

Thus microphones 1 401, 2 403 and 4 407 can be utilized to detect a direction of the arriving sound, however, with the directional ambiguity that the sound could arrive from either of the two sides of the device as determined by the front-back axis. In this example, the microphone pair 1,2 and the pair 1,4 are located exactly at the horizontal and vertical axes. This is an example configuration which enables an example method to estimate the direction expressible in a simple way.

In this embodiment directional information can be determined from the microphone audio signals using the following equations. Firstly assuming the delays between all of the microphone audio channels have been determined and defined with $d_1$ as the delay estimate between microphone pair 1,2; $d_2$ as the delay estimate between microphone pair 1,4; and $d_3$ as the delay estimate between microphone pair 1,3. In this example the front-back information can be estimated from the sign of $d_3$.

One way to determine the direction from the delays is using vector algebra. For example a unit vector v can be defined such that it would point to the direction-of-arrival. The unit vector axes 1 and 2 may be determined from the robustly estimated delays $d_1$ and $d_2$ by $$v = \begin{bmatrix} v_1 \\ v_2 \\ v_3 \end{bmatrix} = \begin{bmatrix} d_1 / d_{1max} \\ d_2 / d_{2max} \\ v_3 \end{bmatrix}$$

where the max-values indicate the maximum possible delay at that axis. In other words the delay which would be determined when the sound arrives at the direction of that axis. Since the length of v is defined 1, we can solve the last dimension by $$v_3 = \pm\sqrt{\max(0,(1-v_1^2-v_2^2))},$$

where the max-operator is to account for the possible small estimation errors where the formula within the square root could provide negative values. The directional ambiguity choice is then retrieved from the sign of $d_3$, or any other similar directional ambiguity choice on that axis. The direction of arrival is thus the direction of vector v, where the front-back parameter has been applied to select the sign of $v_3$, i.e., if the estimated direction should be mirrored to the other side of the device.

Furthermore as microphones 1 and 2 are significantly far apart (for example on a mobile device they would be >4 cm), they would be well suited for detecting coherence. In this example any other microphone pair other than microphone 1 and microphone 3 can be utilized for the coherence analysis. Also, multiple coherence analyses between several pairs could be obtained, and the ratio parameter estimation could combine such coherence information, to arrive to a more robust ratio parameter estimate.

The direction, coherence and other sound characteristics can be detected separately for each frequency band. The spatial metadata as described herein may also be known as directional metadata, spatial metadata, and spatial parametric information, among other terms.

The advantage of selection of one axis (based on the device shape and microphone positions) for only directional ambiguity ('front-back') analysis enables the device to determine accurate spatial metadata within a range of relevant devices where many of the prior methods are not well suited. Specifically the methods described herein enable accurate spatial metadata to be generated using smartphones or tablets or similar devices with at least three microphones where it is known that at least one of the axes of the device is significantly shorter than the other.

For example, when compared to prior art techniques not accounting for the device asymmetry, with the present invention a dry sound source directly at the side of the device (such as shown in FIG. 2*b*) may be accurately captured. With prior art methods, directional metadata may significantly fluctuate because of 'noise' and other errors pronounced at the 'thin' axis. This metadata fluctuation in turn would also significantly affect the spatial reproduction.

In the examples as discussed herein the distance between the microphones is known. However in some embodiments the distance between the microphones may be determined by implementing a training sequence wherein the device is configured to 'test' capture an arriving sound from a range of directions and the delay determination used to find maximum delays between pairs of microphones and thus define the distances between the microphones.

Similarly in some embodiments the actual distances between the microphones is not determined or known and the selection as to whether the pair of microphones may be used to determine a 'directional ambiguity' decision (such as the 'front-back' decision) only or a range of parameter values (such as the positional/orientation or coherence or ratio parameters) may be determined based on a current 'max' delay experienced for the microphones. In such an embodiment the pair of microphone signals may be initially selected to only be able to perform 'directional ambiguity' decisions based on the delay signal analysis. In other words the sign of the delay is used to determine the directional ambiguity decision. However when a max delay value is greater than a determined value (indicating that there is a significant spatial separation between the microphone pair) then the selected pair of microphones may be used to determine more than the directional ambiguity decisions. For example the delay values may be used to determine the spatial metadata direction. This max value may be a determined maximum delay value and thus select whether the pair of microphones is currently suitable for determining the directional metadata, compared to another selection of a pair of microphones.

A parametric analysis of spatial sound is understood to mean that a sound model is assumed, e.g., a directional sound plus ambience at a frequency band. Then, we design the algorithms such that estimate the model parameters, i.e., the spatial metadata. In the embodiments described herein, the sound model involves a directional parameter in frequency bands which is obtained using the directional ambiguity analysis at one spatial axis, and other analysis at the other axis/axes. In some embodiments the directional parameter or other metadata is not stored or transmitted, but is analyzed, utilized for spatial synthesis and then discarded. For example, in some embodiments the device is configured to capture the microphone audio signals and process directly a 5.1 channels output. For example, if there is only a sound source at 30 degrees left, the system estimates the spatial sound model parameters accordingly, and steers the sound to the loudspeaker or loudspeakers at that direction. Thus here the spatial metadata analysis is performed at some part of the system in order to enable spatially accurate reproduction, but in this case the spatial metadata is not stored or transmitted.

In some embodiments the metadata is just a temporary variable within the system that is directly applied for the synthesis (e.g. selection of HRTFs, loudspeaker gains etc.) to produce the spatialized sound. This would be the case where the device is configured to perform both capturing/playback. So, in this case also the metadata is estimated, however, it is not stored anywhere.

In some embodiments the capture device is configured to send one or more audio channels (based on the microphone channels) and the analysed metadata. The audio channels can be encoded e.g. with AAC. The AAC encoding reduces SNR (although the perceptual masking makes the quantization noise typically inaudible), which can reduce the metadata analysis accuracy. This is one reason why the analysis is best done in the capture device. The receiver is configured to retrieve the audio and metadata, and performs the spatialization flexibly, e.g. for head-tracked headphones or loudspeakers.

In some embodiments the device may also store the raw audio waveform as is, and the metadata analysis is performed at another entity, such as a computer software. For example a mobile device camera (one or more) and microphone data is imported to a computer executing code on at least one processor, and all the metadata analysis, picture stitching etc. are performed there. The code or software is informed which device is used, and configures itself accordingly.

Furthermore in some embodiments it may be possible to send the microphone channels encoded at a high bit rate to the receiver and do the metadata analysis and synthesis there.

In the parametric analysis (i.e., an improvement over linear analysis method) the system is configured to estimate spatial parameters, i.e., the spatial metadata, but the analysis may be performed at any suitable point in the system. For example for virtual reality (VR) capture devices like the Nokia OZO device the analysis and estimation often takes place on a computer, and on a mobile device the estimation often takes place on the device itself.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the electronic device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. An apparatus comprising a predetermined shape, the apparatus comprising:

at least three microphones, located on or within the apparatus, wherein at least one pair of the at least three microphones comprises two microphones which are separated with a shorter distance of the predetermined shape than one or more other microphone pair; and a processor configured to:

receive at least three microphone audio signals from the at least three microphones;

analyse at least the microphone audio signals from the two microphones which are separated with the shorter distance to determine a direction ambiguity decision; and analyse the microphone audio signals from at least one pair of the one or more other microphone pair to determine at least one sound characteristic other than a direction ambiguity, wherein the at least one pair of the one or more other microphone pair comprises two microphones separated with a longer distance of the predetermined shape in such a way that the two microphones separated with the longer distance are configured to capture spatial audio signals, wherein the at least one sound characteristic comprises at least a direction angle of arriving sound, wherein the direction angle of the arriving sound has at least one ambiguous value, and wherein the direction ambiguity decision is configured to at least partially resolve the at least one ambiguous value.

2. The apparatus as claimed in claim 1, wherein the predetermined shape is a physical shape of the apparatus and at least one dimension of the physical shape of the apparatus is shorter than other dimensions of the physical shape of the apparatus and wherein the two microphones which are separated with the shorter distance are separated due to the at least one dimension of the physical shape of the apparatus being shorter than other dimensions of the physical shape of the apparatus.

3. The apparatus as claimed in claim 1, wherein the processor configured to analyse at least the microphone audio signals from the two microphones which are separated with the shorter distance is further configured to analyse the microphone audio signals from at least one further pair of the one or more other microphone pair to determine the direction ambiguity decision.

4. The apparatus as claimed in claim 1, wherein the processor is configured to:

determine a first spatial metadata part, the first spatial metadata part being the direction ambiguity decision;

determine a second spatial metadata part, the second spatial metadata part being the at least one sound characteristic other than the direction ambiguity; and combine the first spatial metadata part and the second spatial metadata part to generate spatial metadata associated with the at least three microphone audio signals, and wherein the second spatial metadata part has a greater range of values than the first spatial metadata part.

5. The apparatus as claimed in claim 1, wherein the processor configured to analyse the microphone audio signals from the at least one pair of the one or more other microphone pair to determine the at least one sound characteristic is configured to determine a delay value between microphones of the at least one pair of the one or more other microphone pair.

6. The apparatus as claimed in claim 1, wherein the processor configured to analyse the microphone audio signals from the at least one pair of the one or more other microphone pair to determine the direction angle is configured to:

determine a delay value between the microphone audio signals from the at least one pair of the one or more other microphone pair;

normalise the delay value against a delay value for a sound wave to travel a distance between microphones of the at least one pair of the one or more other microphone pair; and apply a trigonometric function to the normalised delay value, or use the normalised delay value in a look up table, to generate at least two ambiguous direction angle values.

7. The apparatus as claimed in claim 6, wherein the processor configured to analyse at least the microphone audio signals from the two microphones which are separated with the shorter distance to determine the direction ambiguity decision is configured to:

determine a sign of the delay value associated with a maximum correlation value between the microphone audio signals from the two microphones which are separated with the shorter distance, wherein the processor is further configured to resolve the at least two ambiguous direction angle values based on the sign of the delay value.

8. The apparatus as claimed in claim 6, wherein the processor configured to determine the delay value between the microphone audio signals is configured to:

determine a plurality of correlation values for a range of delay values between the microphone audio signals;

perform a search of the plurality of correlation values for a correlation value with a maximum correlation value; and select the delay value from the range of delay values associated with the correlation value with the maximum correlation value.

9. The apparatus as claimed in claim 6, wherein the processor configured to determine the delay value between the microphone audio signals is configured to:

determine a derivative over frequency of a phase difference between the microphone audio signals; and determine the delay value based on the derivative over frequency of the phase difference.

10. The apparatus as claimed in claim 1, wherein the at least one sound characteristic other than the direction ambiguity further comprises at least one of:

an energy ratio associated with the direction angle of the arriving sound; or a coherence associated with the direction angle of the arriving sound.

11. The apparatus as claimed in claim 1, wherein the processor configured to at least one of:

analyse at least the microphone audio signals from the two microphones which are separated with the shorter distance to determine the direction ambiguity decision is configured to analyse, on a frequency-band by frequency-band basis, at least the microphone audio signals from the two microphones which are separated with the shorter distance to determine the direction ambiguity decision; or analyse, on a frequency-band by frequency-band basis, the microphone audio signals from the at least one pair of the one or more other microphone pair to determine the at least one sound characteristic other than the direction ambiguity.

12. The apparatus as claimed in claim 1, wherein the at least three microphones comprise four microphones, the processor configured to receive the at least three microphone audio signals from the at least three microphones is configured to receive four microphone audio signals from the four microphones, the processor configured to analyse the microphone audio signals from the at least one pair of the one or more other microphone pair to determine the at least one sound characteristic other than the direction ambiguity is configured to:

analyse the microphone audio signals from at least two pairs of the one or more other microphone pair to determine at least two delays; and determine an azimuth direction and an elevation direction of the arriving sound from the at least two delays, and the processor configured to analyse at least the microphone audio signals from the two microphones which are separated with the shorter distance to determine the direction ambiguity decision is configured to determine a direction ambiguity decision for at least one of the determined azimuth and elevation directions.

13. A method for an apparatus comprising a predetermined shape, the apparatus comprising: at least three microphones, located on or within the apparatus, wherein at least one pair of the at least three microphones comprises two microphones which are separated with a shorter distance of the predetermined shape than one or more other microphone pair, the method comprising:

receiving at least three microphone audio signals from the at least three microphones;

analysing at least the microphone audio signals from the two microphones which are separated with the shorter distance to determine a direction ambiguity decision; and analysing the microphone audio signals from at least one pair of the one or more other microphone pair to determine at least one sound characteristic other than a direction ambiguity, wherein the at least one pair of the one or more other microphone pair comprises two microphones separated with a longer distance of the predetermined shape in such a way that the two microphones separated with the longer distance are configured to capture spatial audio signals, wherein the at least one sound characteristic comprises at least a direction angle of arriving sound, wherein the direction angle of the arriving sound has at least one ambiguous value, and wherein the direction ambiguity decision is configured to at least partially resolve the at least one ambiguous value.

14. The method as claimed in claim 13, further comprising:

determining a first spatial metadata part, the first spatial metadata part being the direction ambiguity decision;

determining a second spatial metadata part, the second spatial metadata part being the at least one sound characteristic other than the direction ambiguity; and combining the first spatial metadata part and the second spatial metadata part to generate spatial metadata associated with the at least three microphone audio signals, and wherein the second spatial metadata part has a greater range of values than the first spatial metadata part.

15. The method as claimed in claim 13, wherein analysing the microphone audio signals from the at least one pair of the one or more other microphone pair to determine the at least one sound characteristic other than the direction ambiguity comprises determining a delay value between microphones of the at least one pair of the one or more other microphone pair.

16. The method as claimed in claim 13, wherein analysing the microphone audio signals from the at least one pair of the one or more other microphone pair to determine the direction angle further comprises:

determining the delay value between the microphone audio signals from at least one pair of the one or more other microphone pair;

normalising the delay value against a delay value for a sound wave to travel a distance between microphones of the at least one pair of the one or more other microphone pair; and applying a trigonometric function to the normalised delay value, or using the normalised delay value in a look up table, to generate at least two ambiguous direction angle values.

17. The method as claimed in claim 16, wherein analysing at least the microphone audio signals from the two microphones which are separated with the shorter distance to determine the direction ambiguity decision comprises:

determining a sign of the delay value associated with a maximum correlation value between the microphone audio signals from the two microphones which are separated with the shorter distance, wherein the method further comprises resolving the at least two ambiguous direction angle values based on the sign of the delay value.

18. The method as claimed in claim 13, wherein the at least three microphones comprise four microphones, wherein receiving the at least three microphone audio signals from the at least three microphones comprises receiving four microphone audio signals from the four microphones, analysing the microphone audio signals from the at least one pair of the one or more other microphone pair to determine the at least one sound characteristic other than the direction ambiguity further comprises:

analysing the microphone audio signals from at least two pairs of the one or more other microphone pair to determine at least two delays; and determining an azimuth direction and an elevation direction of the arriving sound from the at least two delays, and analysing at least the microphone audio signals from the two microphones which are separated with the shorter distance to determine the direction ambiguity decision comprises determining a direction ambiguity decision for at least one of the determined azimuth and elevation directions.

19. The apparatus as claimed in claim 1, wherein the at least one ambiguous value comprises one of an azimuth value or an elevation value of the direction angle of the arriving sound.

20. The method as claimed in claim 13, wherein the at least one ambiguous value comprises one of the an azimuth value or an elevation value of the direction angle of the arriving south.

* * * * *